United States Patent [19]

Nawa et al.

[11] 4,148,333

[45] Apr. 10, 1979

[54] FLUID DIVERTING ASSEMBLY

[75] Inventors: Motoyuki Nawa; Yutaka Takahashi; Masaru Nishijo, all of Nara, Japan

[73] Assignee: Matsushita Electric Industrial Co., Ltd., Kadoma, Japan

[21] Appl. No.: 740,243

[22] Filed: Nov. 8, 1976

[30] Foreign Application Priority Data

| | | | |
|---|---|---|---|
| Nov. 8, 1975 | [JP] | Japan | 50-134282 |
| Dec. 24, 1975 | [JP] | Japan | 50-176023[U] |
| Dec. 25, 1975 | [JP] | Japan | 50-180169[U] |
| Jan. 23, 1976 | [JP] | Japan | 51-6841[U] |

[51] Int. Cl.[2] ..... F15C 1/08

[52] U.S. Cl. ..... 137/834; 137/836; 137/833

[58] Field of Search ..... 137/834, 835, 836, 839, 137/833

[56] References Cited

U.S. PATENT DOCUMENTS

| | | | |
|---|---|---|---|
| 3,396,619 | 8/1968 | Bowles et al. | 137/810 X |
| 3,425,431 | 2/1969 | Heskestad | 137/836 |
| 3,524,461 | 8/1970 | Pavlin | 137/839 |
| 3,589,382 | 9/1971 | Glass | 137/833 |
| 3,811,474 | 5/1974 | Bauer et al. | 137/833 |

*Primary Examiner*—William R. Cline

*Attorney, Agent, or Firm*—Wenderoth, Lind & Ponack

[57] ABSTRACT

A fluid diverting assembly is constituted by a structural body having a nozzle from which a main stream of fluid is issued as the fluid passes therethrough, a pair of opposed control chambers positioned adjacent the nozzle and on respective lateral sides of the stream of fluid, a pair of side walls outwardly diverging in a direction downstream of the nozzle with respect to the direction of flow of the main fluid stream, and control apertures respectively communicated to the control chambers. An interceptor mechanism is provided for alternately adjustably closing any one of the control apertures for deflecting the direction of flow of the main fluid stream issued by the nozzle.

13 Claims, 23 Drawing Figures

FLUID DIVERTING ASSEMBLY

PRIOR ART (1) U.S. Pat. No. 3,396,619, patented on Aug. 13, 1968.

(2) A publication entitled "FOURTH CRANFIELD FLUIDICS CONFERENCE 17th-20th Mar. 1970. CONVENTRY" (A4-53 to A4-60)

The present invention generally relates to a fluid diverting assembly and, more particularly, to a fluid diverting assembly for use in an air conditioner.

As a device for diverting the direction of flow of fluid, either gas or liquid, a fluid amplifier or diverting element is well known. The conventional fluid diverting element can only be used to deflect the fluid in either of two directions. More specifically, the conventional fluid diverting element has a substantially Y-shaped fluid passage and is so designed that a jet of fluid issuing from a nozzle positioned in a main jet passage is selectively directed towards either one of two passages diverging from each other at a predetermined and limited angle of divergence. In this conventional fluid diverting element, since the angle of divergence of the passages is limited to a relatively small value, the fluid diverting element must have a rectangular configuration having a relatively great length and, therefore, its application is limited.

The use of a fluid diverting element in an air conditioner for deflecting air, either heated or cooled, in any desired direction has heretofore been contemplated. However, because of the limited performance of the conventional fluid diverting element, the actual employment of a fluid diverting element in the air conditioner has not yet been achieved.

Accordingly, the present invention has been developed with a view to providing a fluid diverting assembly which has a relatively wide range of application and which substantially eliminates the foregoing disadvantages inherent in the conventional fluid diverting element.

According to the present invention, one example of application of the fluid diverting assembly of the present invention is in an air conditioner. In this case the fluid diverting assembly of the present invention is installed at an exit through which air, either cooled or heated by a heat exchanger in the air conditioner, is blown into a room to be cooled or heated. Installation of the fluid diverting assembly of the present invention results in uniform distribution of the air from the exit into the room due to the fact that the air emerging from the exit can be continuously swung left and right over a wide angle relative to the point of deflection of flow of such air. In one preferred embodiment of the present invention, for the above described purpose, the assembly is provided with an interceptor mechanism, the operation of which results in a swinging motion of a stream of air emerging from the fluid diverting assembly.

Another example of application of the fluid diverting assembly of the present invention is in a water sprinkler for scattering water over a wide area.

In any event these and other objects and features of the present invention will become apparent from the following description taken in conjunction with preferred embodiments thereof with reference to the accompanying drawings, in which.

Figure 1:
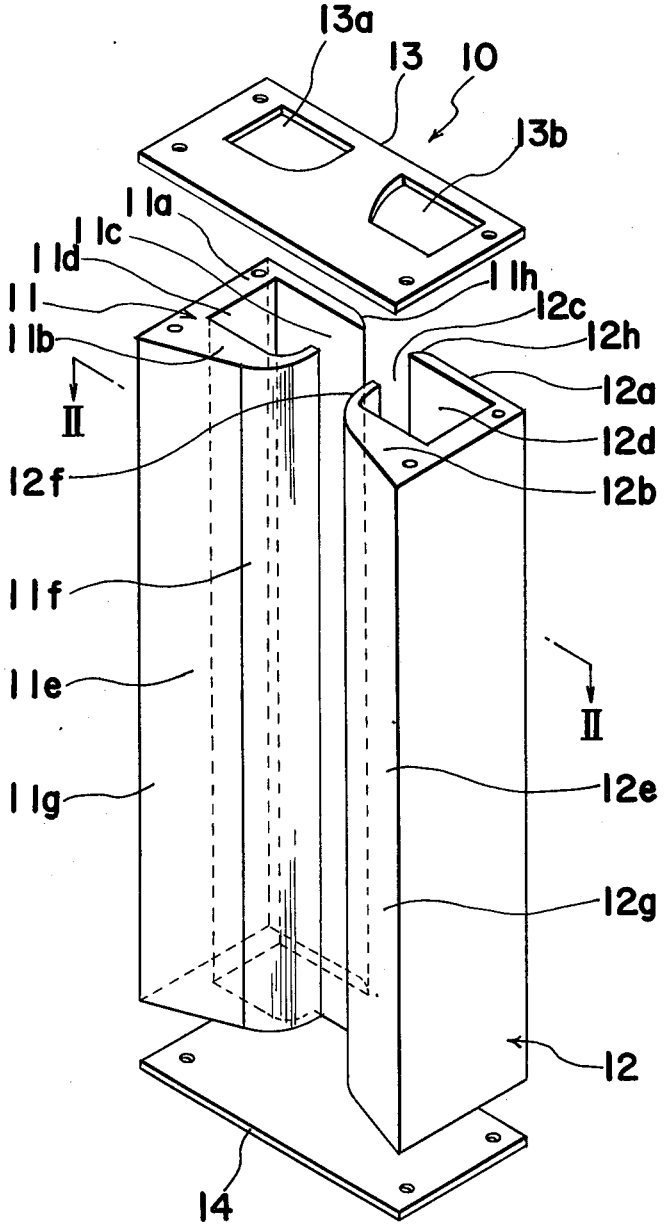
FIG. 1 is an exploded perspective view of a fluid diverting assembly according to one preferred embodiment of the present invention.

Before the description of the present invention proceeds, it is to be noted that like parts are designated by like reference numerals throughout the accompanying drawings. It is also to be noted that, although the term "fluid" hereinbefore and hereinafter referred to as a driving fluid by which the fluid diverting assembly of the present invention operates is intended to include gas and liquid, the following detailed description will be made with air as the driving fluid for the purpose of facilitating a better understanding of the present invention.

Figure 2:
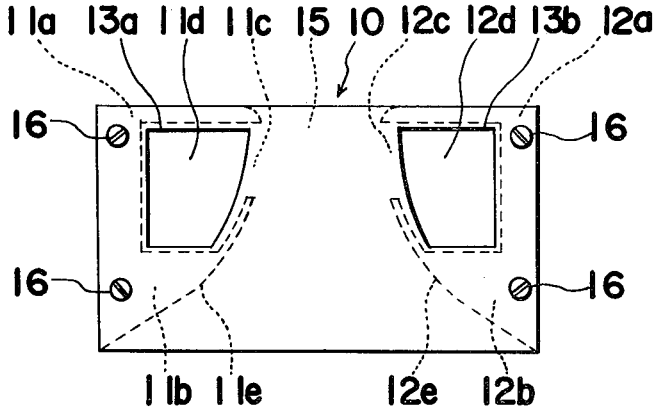
FIG. 2 is an end view of the fluid diverting assembly of FIG. 1.
Figure 3:
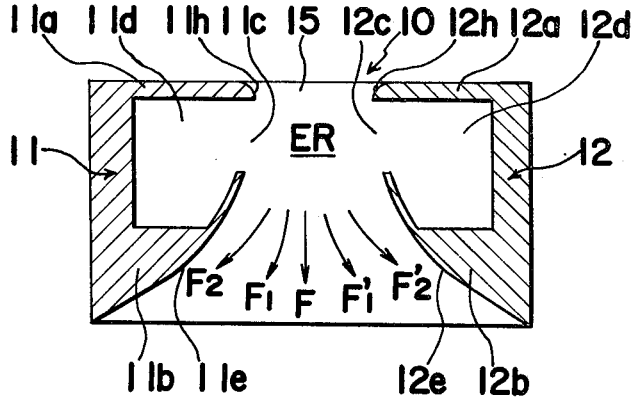
FIG. 3 is a cross sectional view of the fluid diverting assembly, taken along the line II—II in FIG. 1.

Referring now to FIGS. 1 to 3, a fluid diverting assembly according to the present invention, generally indicated by 10, is shown to comprise substantially elongated first and second bodies 11 and 12 having the same construction which are connected in spaced relation to each other by a pair of end plates 13 and 14 in a manner as will be described in more detail later.

Since the first and second elongated bodies 11 and 12 have the same construction, the details of one of the first and second elongated bodies 11 and 12, for example, those of the first elongated body 11, will be described for the sake of brevity. However, it is to be noted that the various parts of the first elongated body 11 are designated by corresponding alphabetical suffixes added to the reference numeral "11", and the same alphabetical suffixes added to the reference numeral "12" are to be understood as designating functionally and structurally corresponding parts of the second elongated body 12.

The first elongated body 11 is shown to comprise a first wall member 11*a* substantially L-shape in section and a second wall member 11*b* substantially J-shape in section. One side of the second wall member 11*b*, which corresponds to the upper end of the shape of a figure "J" of the second wall member 11*b*, is secured to, or otherwise integrally formed with, one side of the first wall member 11*a* while the other side of the second wall member 11*b* is spaced from the other side of the first wall member 11*a* thereby defining an elongated gate 11*c* through which an elongated control chamber 11*d* in the first elongated body 11 defined between the first and second wall members 11*a* and 11*b* opens to the outside of the elongated body 11. The second wall member 11*b* has an outer wall surface 11*e* composed of a curved portion 11*f* adjacent the elongated gate 11*c* which diverges from the corresponding surface 12*f* on the second elongated body 12 and a flat portion 11*g* which is contiguous to the curved portion 11*f*.

The first and second elongated bodies 11 and 12 the same construction and each having the construction as hereinbefore described are connected, as hereinbefore described, to each other by the rectangular end plates 13 and 14 in such a manner that the other sides of the first wall members 11*a* and 12*a* of the respective first and second bodies 11 and 12 are spaced from each other to define an entrance 15 and the gates 11*c* and 12*c* are opposed to each other as best shown in FIG. 3. One of the end plates, for example, the end plate 13, has a pair of control apertures 13*a* and 13*b* therein having a shape similar to the cross sectional contour of the control chambers 11*d* and 12*d*, said control apertures 13*a* and 13*b* being, when said end plate 13 is secured to respective ends of the first and second elongated bodies 11 and 12 by means of a plurality of screws 16 as shown in FIG. 2, in communication with the control chambers 11*d* and 12*d*, respectively. The other end plate 14, secured to the other ends of the elongated bodies 11 and 12 in a manner similar to the end plate 13, serves to connect the first and second elongated bodies 11 and 12 in spaced relation to each other in a similar manner to the end plate 13 on one hand and to close respective openings of the control chambers 11*d* and 12*d* at said other ends of the bodies 11 and 12 on the other hand.

The fluid diverting assembly 10 having the above described construction is so designed that air entering the entrance 15 under pressure from one side of the assembly 10 as a driving fluid flows, in the form of a substantially ribbon-shaped stream, towards the opposite side of the assembly 10 through an entrainment region ER, which is defined between and laterally of the gates 11*c* and 12*c*, and then through a space or passage, which is defined between the respective side wall surfaces 11*e* and 12*e* of the elongated bodies 11 and 12, in a substantially outwardly enlarged configuration. During the flow of the driving fluid through the entrainment region ER, the driving fluid does not enter either of the control chambers 11*d* or 12*d*, but draws into the stream air contained in the control chambers 11*d* and 12*d* which are communicated with the atmosphere through the associated control aperture 13*a* and 13*b* in the end plate 13. More specifically, as the driving fluid flows through the entrainment region ER, air contained in the control chambers 11*d* and 12*d* is drawn through the gates 11*c* and 12*d* into the ribbon-shaped stream of driving fluid and, therefore, the stream comes straight, that is, in a direction as indicated by the arrow F in FIG. 3, out from the entrance 15 without deflecting in either direction towards either of the side wall surfaces 11*e* and 12*e*. This can be achieved if the cross-sectional area of each of the gates 11*c* and 12*c* and the cross-sectional area of each of the control apertures 13*a* and 13*b* are so selected as to minimize the resistance to the flow of air from the atmosphere into the entrainment region ER through the control aperture, then through the control chamber and finally through the gate to such an extent that entrainment of the air into the driving fluid can be facilitated.

If one of the control apertures 13*a* and 13*b*, for example, the control aperture 13*a*, is partially closed by any suitable closure means, the pressure within the control chamber 11*d* becomes lower than the pressure within the control chamber 12*d*, which is atmospheric pressure, and the amount of air drawn into the driving fluid from the control chamber 11*d* through the gate 11*c* at the entrainment region ER becomes smaller than that drawn into the same driving fluid from the control chamber 12*d* through the gate 12*c* at the same place. By the effect of a pressure differential thus developed between the control chambers 11*d* and 12*d*, the ribbon-shaped stream of driving fluid from the entrance 15 is then deflected at a certain angle in a direction towards the side wall surface 11*e* as indicated by the arrow $F_1$ in FIG. 3. It is to be noted that during the flow of the driving fluid in the direction as indicated by $F_1$ incident to the partial closure of the control aperture 13*a*, the gap between the side wall surface 11*e* and the opposed side of the ribbon-shaped stream of driving fluid which is adjacent said side wall surface 11*e* gradually increases from the upstream end towards the downstream end because of the substantially outwardly diverging configuration of the side wall surfaces 11*e* and 12*e*. This means that during the partial closure of the control aperture 13*a*, adherence of the ribbon-shaped stream of driving fluid, that is, air, to the side wall surface 11*e* does not take place although the ribbon-shaped stream of driving air is deflected at a certain angle from the center plane of the assembly 10 which is defined as lying perpendicular to the plane of the entrance 15 and passing intermediate the side wall surfaces 11*e* and 12*e* and also intermediate the width of the entrance 15.

If the control aperture 13*a* is subsequently completely, or substantially completely, closed by the suitable closure means, the pressure at the gate 11*c* rapidly decreases to such an extent that the ribbon-shaped stream of driving fluid is further deflected thereby flowing along the side wall surface 11*e*, flowing in a direction as indicated by arrow $F_2$ in FIG. 3.

If the control aperture 13*b* is partially or completely closed by the suitable closure means, the fluid diverting assembly 10 according to the present invention operates in a substantially reversed manner to that described above. In other words, if the control aperture 13*b* is partially closed, the ribbon-shaped stream of driving air from the entrance 15 flows in a direction, as indicated by $F'_1$, being diverted from the center plane of the assembly 10 and without adhering to the side wall surface 12*e*. On the other hand, if the control aperture 13*b* is completely, or substantially completely, closed, the ribbon-shaped stream of driving air from the entrance 15 flows, as indicated by $F'_2$, along the side wall surface 12*e*.

In summary, the operation of the fluid diverting assembly according to the present invention is such that, depending upon the extended to which either one of the control apertures 13*a* and 13*b* which is controlled by the suitable closure means is open, the ribbon-shaped stream of driving fluid can be deflected at different angles relative to the center plane of the assembly 10 and in a direction laterally in either direction from the center plane of the assembly 10.

In order to make the driving fluid entering the entrance 15 unstable and, therefore, easy to deflect in the manner as hereinbefore described, the respective sides of the first wall members 11*a* and 12*a* of the elongated bodies 11 and 12, which cooperate to define the entrance 15, are preferably so designed as to have a relatively small thickness and an outwardly curved corner at one side edge remote from the entrainment region ER as indicated by 11*h* and 12*h*, so that the entrance 15 has a width which is gradually decreasing in the direction of the flow of the driving fluid towards the entrainment region ER. The reason why the stream of driving air is easier to deflect because of the particular construction of the sides of the first wall members 11*a* and 12*a* of the elongated bodies 11 and 12 defining the entrance 15 is that the entrance 15 as thus defined serves as an orifice which accelerates the flow of driving air through the entrance 15 and the driving air, after having emerged from the entrance 15 into the entrainment region ER, contains turbulent components tending to deflect the ribbon-shaped stream of the driving air laterally of the center plane of the assembly 10. It is noted that the curvature of the corner 11*h* contributes to deflection of the driving air towards the side wall surface 12*e* while the curvature of the corner 12*h* contributes to deflection of the driving air towards the side wall surface 11*e*.

In this regard, if the curvature of the corners 11*h* and 12*h* is constituted by a quarter of the circumference of a circle, the smaller the radius of curvature of such circle, the moe effective the deflection of the ribbon-shaped stream of driving air. However, in practice, a smaller curvature of the corner 11*h* or 12*h* is undesirable because it causes a relatively great pressure loss.

Figure 4:
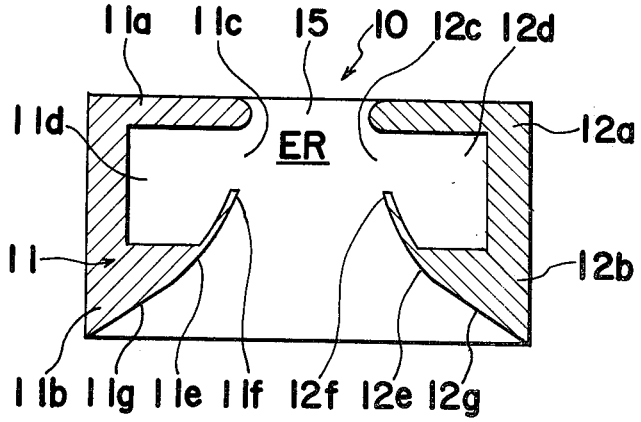
FIG. 4 is a view similar to FIG. 3, showing a modification of the fluid diverting assembly.

As shown in FIG. 4, the respective sides of the first wall members 11*a* and 12*a* of the elongated bodies 11 and 12, which define the entrance 15, may be outwardly rounded so that the entrance 15 can have a converging and diverging profile from the upstream side towards the downstream side with respect to the direction of flow of the driving fluid or air. The arrangement of the entrance 15 shown in FIG. 4 is particularly advantageous in that a noise, such as a whistling sound, of a nature generated by the passage of the driving air through the entrance 15 can be minimized or substantially eliminated.

In the fluid diverting assembly 10 having the construction shown in FIGS. 1 to 3, if the control apertures 13*a* and 13*b* are simultaneously partially closed, a negative pressure is developed in each of the control chambers 11*d* and 12*d* and, particularly, at each of the gates 11*c* and 12*c*, which negative pressure continues to fluctuate due to the fact that generation of this negative pressure depends on a minute gap defined between the ribbon-shaped stream of driving air and either one of the upstream sides of the respective curved portion 11*f* and 12*f* of the side wall surfaces 11*e* and 12*e*.

Assuming that, while the negative pressures at the gates 11*c* and 12*c* continue to fluctuate, the pressure at the gate 11*c* falls below the pressure at the gate 12*c*, the ribbon-shaped stream of driving air starts deflecting towards the side wall surface 11*e*, gradually decreasing the gap between the stream and the upstream side of the curved portion 11*f* of the side wall surface 11*e*. As this gap gradually decreases, the pressure at the gate 11*c* is further lowered and the gap between the stream and the upstream side of the curved portion 12*f* of the side wall surface 12*e* consequently increases. Upon increase of the gap between the stream and the upstream side of the curved portion 12*f* of the side wall surface 12*e*, the pressure at the gate 12*c* increases and the consequence is that the stream is further deflected towards the side wall surface 11*e*. This mode of operation is referred to as a positive feedback and the ribbon-shaped stream of driving air is ultimately stabilized at a position near the side wall surface 11*e*.

If the control apertures 13*a* and 13*b* are respectively closed and opened after this condition has been established, the direction of deflection of the ribbon-shaped stream of driving air can be switched over to the other direction, thereby poviding a bistable operation.

If the upstream side of either of the curved portions 11*f* and 12*f* is so positioned as to keep away the ribbon-shaped stream of driving air flowing through the entrainment region ER towards the passage between the side wall surfaces 11*e* and 12*e*, the stream can be caused to flow along either one of the side wall surfaces 11*e* and 12*e* merely by the closure of a corresponding one of the control apertures 13*a* and 13*b* without exhibiting a proportional mode of operation.

An example of application of the fluid diverting assembly 10 having the construction of FIGS. 1 to 3 to an air conditioner will now be described with particular reference to FIGS. 5 to 9. It is, however, to be noted that the air conditioner shown particularly in FIGS. 5 and 6 is of a type generally referred to as "window model" or "window mounted model" and includes indoor and outdoor heat exchangers housed in a single housing adapted to be mounted on an existing window or a partition wall in a manner with the indoor and outdoor heat exchangers exposed respectively to the room and the outside of, for example, a house.

Figure 5:
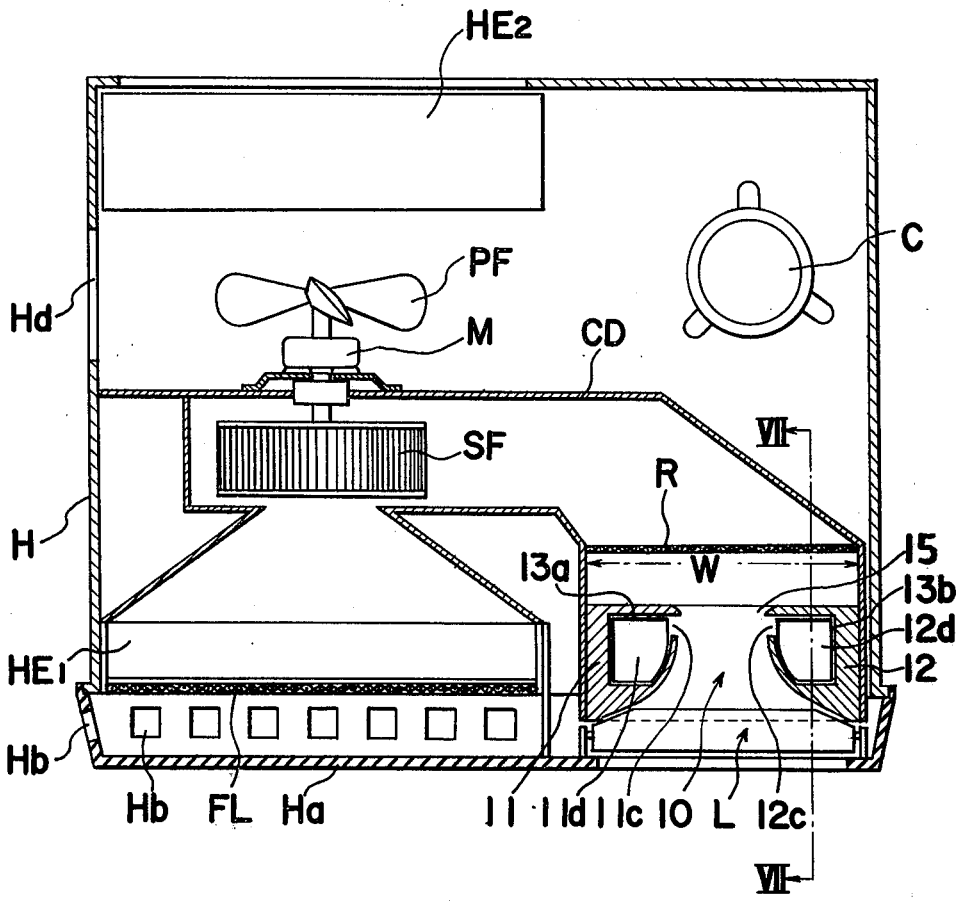
FIG. 5 is a top sectional view of an air conditioner of the window mounted type utilizing the fluid diverting assembly shown in FIGS. 1 to 3.
Figure 6:
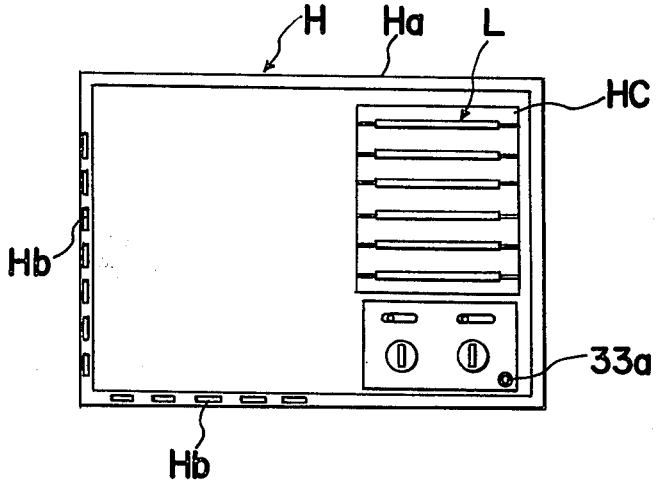
FIG. 6 is a front elevational view, on a reduced scale, of the air conditioner shown in FIG. 5.

Referring now to FIGS. 5 and 6, the illustrated air conditioner comprises a shousing H having substantially rectangular cubic shape and having an opening in one side, which opening is closed by a decorative front panel H*a*. The front panel H*a* is shown to have a plurality of intake apertures and an exit grill respectively formed at Hb and Hc.

Within the housing H, there is accommodated indoor and outdoor heat exchangers $HE_1$ and $HE_2$ operable in substantially opposite relation to each other in such a manner that, when it is desired to be exitted from the exit grill Hc, the heat exchanger $HE_1$ having a coolant flowing therethrough serves to cool air introduced from the outside, for example, air within a house room, through the intake apertures Hb while the heat exchanger $HE_2$ serves to cool the coolant which has been used to cool the air from the house room. For circulating the coolant in one direction from the heat exchanger $HE_1$ to the heat exchanger $HE_2$ and then from the heat exchanger $HE_2$ to the heat exchanger $HE_1$, a compressor C is used and housed within the housing H. A propeller fan PF is used to produce a forced draft of air towards the outside, after having been drawn into the housing through a side intake grill Hd, past the heat exchanger $HE_2$ to cool the coolant flowing through the heat exchanger $HE_2$. This fan PF is shown to be driven in one direction by an electric motor M of a type shown as having coaxial shafts extending in the opposite directions, one of these motor shafts having the fan PF rigidly mounted thereon and the other of these motor shafts having a Sirocco fan SF rigidly mounted thereon.

The housing H has therein a closed duct CD having one end connected to the outer periphery of the heat exchanger $HE_1$ and the other end having the fluid diverting assembly 10 installed therein in a manner as will be described in more detail later. It is to be noted that the motor M is shown is being supported by a wall forming a part of the closed duct CD while the Sirocco fan SF is so positioned within the closed duct CD as to direct the cooled air, after it has passed through the heat exchanger $HE_1$, towards the fluid diverting assembly 10 and through the exit grill Hc.

The air conditioner shown includes a removable filter FL positioned in front of the heat exchanger $HE_1$ for removing dust, contained in the air to be passed from the house room through the exchanger $HE_1$, and a rectifier R having a construction which is similar to the filter FL and is shown as being positioned rearwardly of the assembly 10 for rectifying the flow of cooled air being directed within the closed duct CD towards the assembly 10.

The exit grill Hc in the front panel Ha is shown as having an adjustable louver L composed of a plurality of transversely extending blade members in spaced and parallel relation to each other. The louver assembly L serves to select the direction of flow of the cooled air passing through the exit grill Hc as desired. Specifically, for a reason which will become clear later, the louver assembly L is shown as being for adjusting the direction of flow of the cooled air to any vertical position as viewed in FIG. 6.

It is to be noted that, except for the employment of the fluid diverting assembly 10 according to the present invention, the air conditioner of the construction so far described is conventional and well known to those skilled in the art and, therefore, the details thereof, including the description of the operation thereof, are omitted for the sake of brevity.

Figure 7:
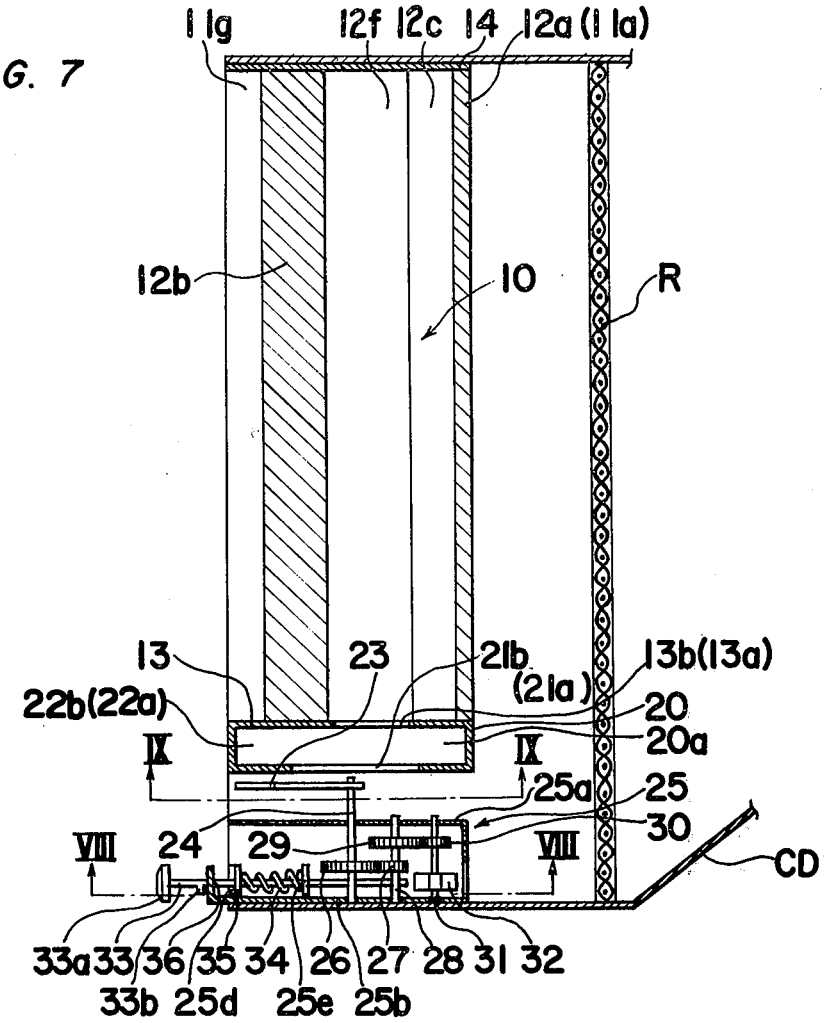
FIG. 7 is a cross sectional view, on an enlarged scale, taken along the line VII—VII in FIG. 5.
Figure 8:
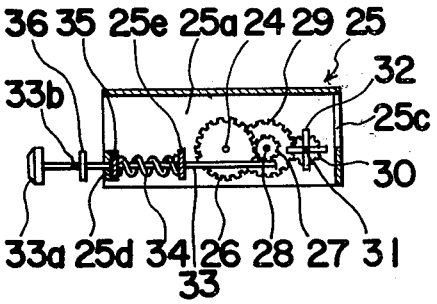
FIG. 8 is a cross sectional view taken along the line VIII—VIII in FIG. 7.
Figure 9:
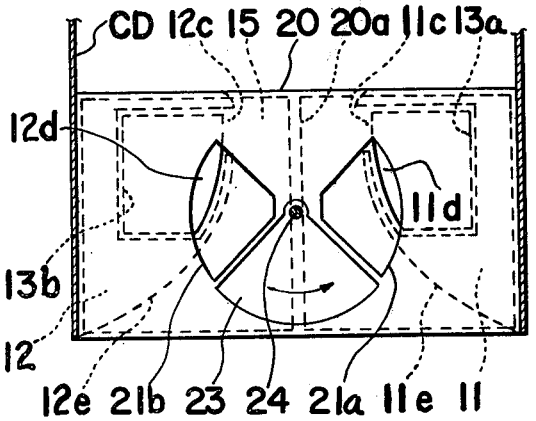
FIG. 9 is a cross sectional view, on an enlarged scale, taken along the line IX—IX in FIG. 7, showing a relative position of the shutter to one end of the fluid diverting assembly.

With particular reference to FIGS. 7 to 9, there is illustrated the manner in which the fluid diverting assembly 10 is installed at one end of the closed duct CD adjacent the front exit grill Hc of the air conditioner housing H. The fluid diverting assembly 10 is installed within the closed duct CD at one end thereof adjacent the exit grill Hc with the entrance 15 of the assembly 10 facing rearwardly of, i.e., in a direction opposite to, the exit grill Hc. A box 20 having a contour similar to the shape of the end plate 13 and further having a partition wall 20a therein is externally secured to the end plate 13 and has chambers 22a and 22b separated from each other by the partition wall 20a defined below the end plate 13, which chambers 22a and 22b are respectively communicated with the control chambers 11d and 12d through the control apertures 13a and 13b. The box 20 has a pair of spaced segmental apertures formed at 21a and 21b, respectively, through which segmental apertures 21a and 21b the respective chambers 22a and 22b are also communicated to the closed duct CD for the admission of the cooled air into the control chambers 11d and 12d through the segmental apertures 21a and 21b and then the control apertures 13a and 13b via the associated chambers 22a and 22b.

In practice, however, the segmental apertures 21a and 21b are alternately closed by a segmental shutter 23, as will be described later, and therefore, when either one of the segmental apertures 21a and 21b is completely or substantially completely, closed by the segmental shutter 23, a portion of the cooled air from the closed duct CD or the outside enters the other of the segmantal apertures 21a and 21b and then into one of the control chambers 11d and 12d which is in communication with said other of said segmental apertures 21a and 21b.

The segmental shutter 23 is mounted on a shaft 24 for rotation together with said shaft 24, which shaft 24 is driven by a portion of the cooled air in a manner as will now be described in more detail.

Referring still to FIGS. 7 to 9, the shaft 24 has one end rigidly connected to the shutter 23 and the other end rotatably extending through an upper support wall 25a of a support structure 25 and journalled in a lower support wall 25b of the same structure 25. A gear 26 is rigidly mounted on the shaft 24 and situated within a space defined between the upper and lower support walls 25a and 25b, which gear 26 is held in constant meshed relation to a gear 27 rigidly mounted on a shaft 28 together with a gear 29. The shaft 28 has its opposed ends journalled in the walls 25a and 25b, respectively, and the gear 29 is held in constant meshed relation to a drive gear 30 rigidly mounted on a shaft 31 together with a wind impeller 32. This shaft 31 also has its opposed ends journalled in the walls 25a and 25b, respectively. The arrangement of these gears 26, 27, 29 and 30 is so designed that rotation of the wind impeller 32, which is produced by the flow of a portion of the cooled air entering in inlet 25c in one end wall of the support structure 25, is transmitted to the shaft 24 via the train of these gears to drive the shaft 24 and, therefore, the shutter 23 in one direction at a reduced, lower velocity than the velocity of rotation of the wind impeller 32. It is to be noted that the position and size of the inlet 25c is so selected as to permit the impeller 32 to rotate in one direction.

While a drive mechanism for driving the shutter 23 in one direction shown in FIGS. 7 to 9 is constituted by the wind impeller 32 adapted to be driven by a portion of the cooled air entering the inlet 25c, there is also provided a switching mechanism for selectively bringing the drive mechanism into operative and inoperative positions. This switching mechanism comprises an elongated control rod 33 supported by a pair of spaced lugs 25d and 25e for axial sliding movement between inoperative and operative positions and normally biased to the operative position, as shown in FIGS. 7 and 8, by a compression spring 34 which is disposed around the rod 33 and between the lug 25e and a stop 35 rigidly mounted on said rod and situated between the lugs 25*d* and 25*e*. When the control rod 33 is held in the operative position as shown in FIGS. 7 and 8, one end of the rod 33 which is situated within the closed duct CD and below the assembly 10 is disengaged from the wind impeller 32 and, therefore, the impeller 32 is free to rotate due to the flow of that portion of the cooled air entering the inlet 25*c*. If a button 33*a* at the other end of the control rod 33 is, however, pushed to move the rod 33 from the operative position towards the inoperative position against the action of the compression spring 34, that end of the rod 33 opposite the button 33*a* is engaged with the impeller 32 thereby stopping rotation of the impeller 32. For maintaining the control rod 33 temporarily and as long as desired at the inoperative position, an engagement member 36, which may be a part of the support structure 25, is provided for engagement with a lateral projection 33*b* integral with the control rod 33. The engagement member 36 is to be understood as having a keyhole shape hole and, therefore, the control rod 33 can be retained in the inoperative position after the button 33*a* has been pushed and subsequently turned about the control rod 33. Release of the control rod 33 from the inoperative position can be effected in a reverse manner.

Alternatively, the drive mechanism may be constituted by an electric motor in which case the switching mechanism may be composed of an electric power switch inserted in an electric circuit for the electric motor.

It is to be noted that the segmental apertures 21*a* and 21*b* are so selected as to have a cross-sectional area or opening sufficient to allow the assembly 10 to function in a a tristable, proportional mode of operation as described in connection with the control apertures 13*a* and 13*b* with reference to FIGS. 1 to 3. It is also to be noted that the shutter 23 is preferably positioned a predetermined distance from a common plane between the apertures 21*a* and 21*b*.

From the foregoing description, it is clear that, during rotation of the Sirocco fan SF, the cooled air is directed towards the assembly 10. In practice, the cooled air so directed flows, after having been rectified by the rectifier R, in part through the entrance 15 of the assembly 10 and in part towards an area below the assembly 10. The cooled air flowing into the area below the assembly 10 is further directed in part towards the impeller 32 to drive the latter and in part, in addition to the air flowing from the outside, towards one or both of the chambers 22*a* and 22*b* which are respectively in communication with the control chambers 11*d* and 12*d* through the associated control apertures 13*a* and 13*b*.

As hereinbefore described, rotation of the impeller 32 results in rotation of the shutter 23 in one direction, for example, in the direction as indicated by the arrow in FIG. 9. If and when both of the segmental apertures 21*a* and 21*b* are not closed by the shutter 23 as shown in FIG. 9, the air flows into both of the control chambers 11*d* and 12*d* through the segmental apertures 21*a* and 21*b* and then through the control apertures 13*a* and 13*b*, respectively. Therefore, for the reason which has already been described with reference to FIGS. 1 to 3, the air entering the entrance 15 of the assembly 10 flows straight out from the exit grill H*c* without being deflected in a direction either to the left or to the right as viewed in FIG. 6, that is, towards either of the side wall surfaces 11*e* and 12*e*. However, depending upon the positioning of the louver blades, the ribbon-shaped stream of cooled air emerging from the assembly 10 may be deflected, for example, upwards or downwards as viewed in FIG. 6.

During the continued rotation of the shutter 23 about the shaft 24 and as the shutter 23 gradually closes the segmental aperture 21*a*, the pressure within the control chamber 11*d* is correspondingly lowered and the stream of cooled air is deflected laterally of the center plane of the assembly 10 and in a direction close to the side wall surface 11*e*. A complete deflection, that is, the condition in which the stream of cooled air flows outwards while flowing along the side wall surface 11*e*, is established when the shutter 23 during the continued rotation thereof completely, or substantially completely, closes the segmental aperture 21*a*. By the time the shutter 23 is rotated through 180° from the position as shown in FIG. 9, the segmental aperture 21*a*, which has been closed by the shutter 23, is reopened and, therefore, the stream of cooled air which has been deflected so as to flow along the side wall surface 11*e* is brought to the original state flowing straight out from the exit grill H*c* along the center plane of the assembly 10.

A similar, but reversed operation takes place as the shutter 23 is further rotated to close the segmental aperture 21*b*.

In summary, the foregoing arrangement is so designed that, as the segmental apertures 21*a* and 21*b* are alternately closed and opened during one complete rotation of the shutter 23, the stream of cooled air issuing from the fluid diverting assembly 10 reciprocally swings from left to right and then in right to left as viewed from FIG. 6. Accordingly, it is clear that repeated swings of the stream of cooled air can be effected so long as the control rod 33 is held in the operative position as shown in FIGS. 7 and 8.

Where the lateral swing of the stream of cooled air is not desired, what is necessary is to bring the control rod 33 into the operative position, at which time the stream of cooled air ceases to swing.

In constructing the air conditioner with the fluid diverting assembly 10 incorporated therein, care must be taken to provide the rectifier R, because, without the rectifier R, uniform deflection and flow of the stream of cooled air along the wall will not be achieved because of uneven velocity distribution within the flow of air space rearwardly of the assembly 10. In addition, since the angle of deflection relative to the center plane of the assembly 10 is also dependent on the design of the area upstream of the assembly 10 and, particularly, the entrance 15, the width of the closed duct CD at a portion adjacent the assembly 10, as indicated by W in FIG. 5 and as measured between the side walls forming the closed duct CD in a direction transversely of the lengthwise direction of the assembly 10, must be greater than the width of the entrance 15.

The fluid diverting assembly 10 which can be employed in the air conditioner shown in FIGS. 5 and 6 may be constructed as shown in FIGS. 10 to 18.

Referring to FIGS. 10 to 14, an interceptor mechanism for selectively closing and opening either of the control apertures 13*a* and 13*b*, which is constituted by the shutter 23 in the foregoing embodiment of FIGS. 5 to 9, can be comprised of a cylindrical rotary shutter 40 having a cylindrical wall 41 and a circular disc 42 integrally formed with one end of the cylindrical wall 41. This cylindrical shutter 40 has windows 41*a* and 41*b* in the cylindrical wall 41, and a pair of spaced holes 42*a* and 42*b* in the disc 42.

This cylindrical rotary shutter 40 is rotatably mounted on a cylindrical boss 43 having a pair of substantially V-shaped passages 43a and 43b spaced 180° from each other around the boss 43 and each extending completely through the length of said boss 43, the length of said boss 43 being so selected as to allow the boss 43 to be completely inserted into the cylindrical shutter 40. The boss 43 having the above construction is rigidly mounted on, or otherwise integrally formed with, a plate member 44 having a shape similar to the end plate 13 of the assembly 10, which plate member 44 has a pair of apertures 44a and 44b defined therein spaced 180° from each other around the plate, the plate member being rigidly mounted externally of the end plate 13 and being spaced from and connected to said end plate 13 by a wall 45 enclosing the space between said end plate 13 and said plate member 44. Within the space defined by the wall 45 between the plates 13 and 44, there is installed a partition wall 46 dividing such space into two chambers 47a and 47b respectively in communication with the control chambers 11d and 12d through the associated control apertures 13a and 13b.

Figure 16:
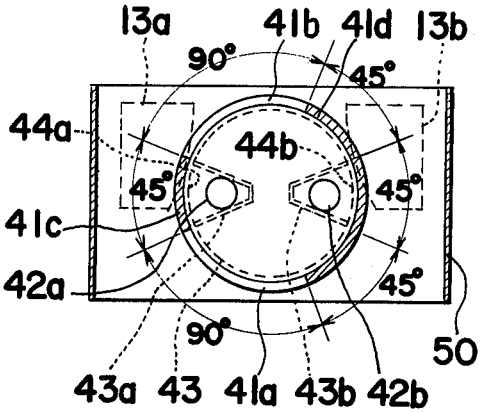
FIGS. 16 to 18 are cross sectional views, taken along the line XVI—XVI in FIG. 14, illustrating different positions of a rotary shutter employed in the fluid diverting assembly of FIGS. 10 to 14.

It is to be noted that the segmental apertures 44a and 44b in the plate member 44 are so positioned as to communicate with the respective chambers 47a and 47b while the boss 43 is mounted on the plate member 44 with the passages 43a and 43b respectively aligned with the segmental apertures 44a and 44b. It is also to be noted that each of the segmental apertures 44a and 44b, while they are spaced 180° from each other, has a curved or arcuate edge extending through, for example, 45° about the center of the radius of curvature of said arcuate edge. The windows 41a and 41b in the cylindrical wall 41 of the rotary shutter 40 extend circumferentially through 90° about the axis of rotation of said rotary shutter 40 and one end of the window 41a is spaced 45° from the other end of the window 41b adjacent said one end of said window 41a while the other end of the window 41a is spaced 135° from the one end of the window 41b adjacent said other end of said window 41a, as best shown in FIG. 16. More specifically, the cylindrical wall 41 has interceptor wall portions 41c and 41d respectively positioned between said one end of the window 41a and said other end of the window 41b and between said other end of the window 41a and said one end of the window 41b.

Figure 11:
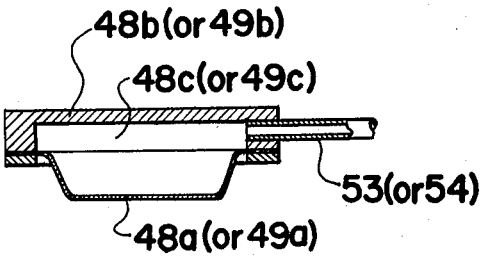
FIG. 11 is a sectional view of one of two identical diaphragm units employed in the fluid diverting assembly shown in FIG. 10.
Figure 12:
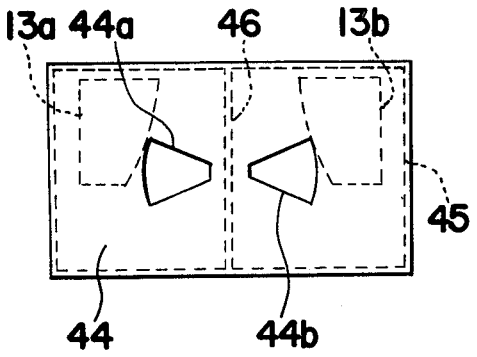
FIG. 12 is an end view of the fluid diverting assembly shown in FIG. 10, which end view is substantially taken along the line XII—XII in FIG. 14.
Figure 13:
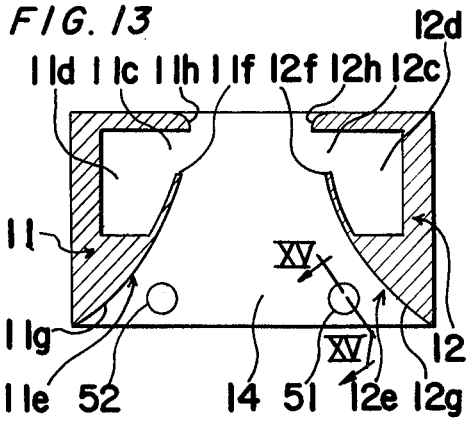
FIG. 13 is a cross sectional view of the fluid diverting assembly shown in FIG. 10, which cross sectional view is taken along the line XIII—XIII in FIG. 14.
Figure 14:
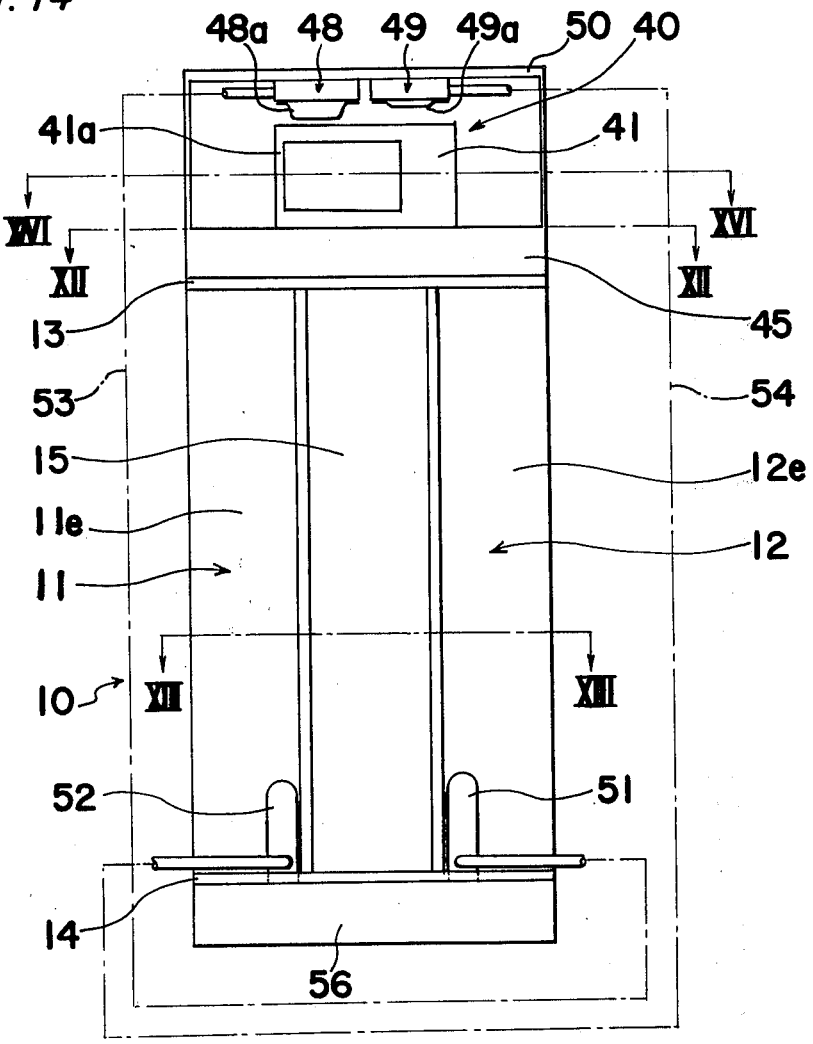
FIG. 14 is a front elevational view of the fluid diverting assembly shown in FIG. 10.

Gating diaphragm units 48 and 49, each having a construction as best shown in FIG. 11 and having a flexible diaphragm member 48a or 49a secured to a rigid structure 48b or 49b which defines a diaphragm chamber 48c or 49c in cooperation with said diaphragm 48a or 49a, are respectively mounted above the disc 42 of the cylindrical rotary shutter 40 with the diaphragm members 48a and 49a positioned immediately above the holes 42a and 42b. As best shown in FIG. 14, for supporting the diaphragm units 48 and 49 in the manner as hereinabove described, an overhang support structure, generally indicated by 50, is employed and is mounted on the plate member 44.

It is to be noted that the holes 42a and 42b in the disc 42 have a cross-sectional area or opening so selected as to provide a bistable mode of operation. Furthermore, the windows 41a and 41b in the cylindrical wall 41 have a cross-sectional area or opening so selected as to provide a tristable and proportional modes of operation.

Referring still to FIGS. 10 to 14, the diaphragm units 48 and 49 are pneumatically connected to respective pneumatic sensors 51 and 52, each having a construction which will be described later, by means of guide pipes 53 and 54, each having one end in communication with the diaphragm chamber 48c or 49c and the other end coupled to the sensor 51 or 52.

It is to be noted that, since the sensors 51 and 52 have the same construction, only one of these, for example, the sensor 51, will now be described in more detail with particular reference to FIG. 15.

Figure 15:
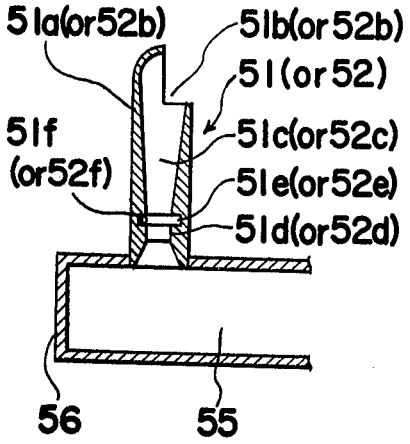
FIG. 15 is a cross sectional view, taken along the line XV—XV in FIG. 13, showing one of two identical fluid sensors employed in the fluid diverting assembly of FIGS. 10 to 14.

Referring to FIG. 15, the sensor 51 comprises an elongated tube 51a having one end rigidly mounted on the end plate 14 in a manner which will be described later, and the other end curved so as to open in a direction laterally of the longitudinal axis of said sensor 51 as shown at 51b. The tube 51a has formed therein a downwardly tapered output passage 51c and a downwardly enlarged supply passage 51d in coaxial relation to the output passage 51c. The tube 51a also has formed therein an annular groove 51e radially outwardly extending within the tube 51a and positioned substantially intermediate between the passages 51c and 51d, which annular groove 51e is in turn communicated to the associated guide pipe 53 through a port 51f. It is to be noted that the minimum inner diameter of the output passage 51c at a position adjacent the annular groove 51e should be greater than that of the supply passage 51d at a position adjacent the annular groove 51e.

Figure 10:
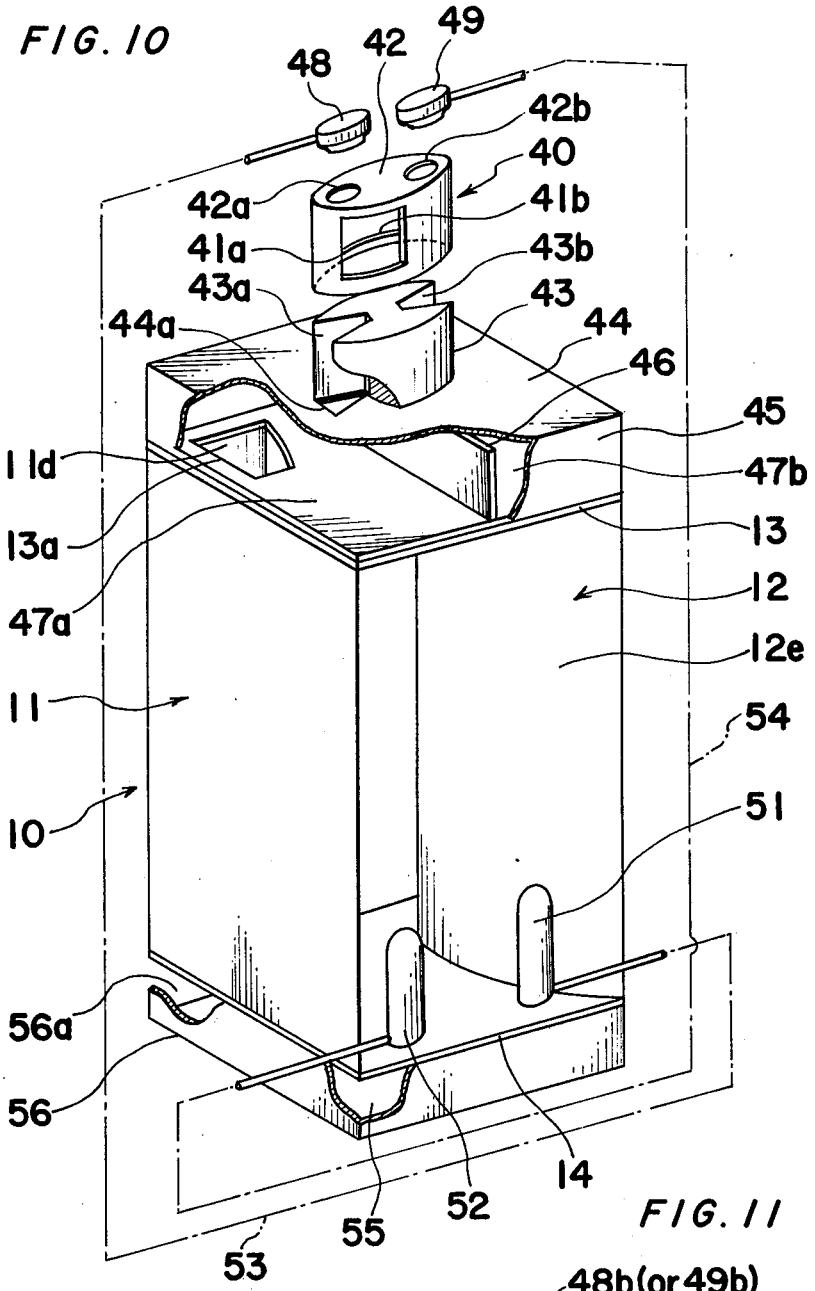
FIG. 10 is an exploded perspective view of a fluid diverting assembly according to another preferred embodiment of the present invention.

Each of the sensors 51 and 52 constructed such as hereinbefore described, as shown in FIGS. 10, 14 and 15 are rigidly mounted on the end plate 14, extending upwards therefrom and are positioned respectively adjacent the straight portions 12g and 11g of the associated side wall surfaces 12e and 11e in parallel relation to the latter. The respective supply passages 51d and 52d of the sensors 51 and 52 thus mounted on the end plate 14 are communicated to a common supply chamber 55 defined below the end plate 14 by a box-like structure 56 secured to said end plate 14. The supply chamber 55 is in turn communicated to the same source of cooled air through a side opening 56a opening in the same direction as the entrance 15, that is, in the direction towards the rectifier R (FIGS. 5 and 7). Each of the sensors 51 and 52 thus constructed and mounted as hereinbefore described operates in the following manner.

The sensor 51 or 52, when the stream of cooled air issuing from the entrance 15 flows through the passage between the side wall surfaces 11e and 12e, senses or detects whether or not the stream of cooled air is deflected and the direction of deflection of such stream of cooled air, in a manner as will now be described. A portion of cooled air from the rectifier R is continuously fed to both of the sensors 51 and 52 through the supply chamber 55 defined below the end plate 14. Therefore, the air under pressure within the chamber 55 flows in part to the atmosphere through the open end 51b via the passages 51d and 51c of the sensor tube 51a and in part to the atmosphere through the open end 52b via the passage 52d and 52c of the sensor tube 52a.

If there is no counter-flow of air at the open end 51b or 52b of the sensor 51 or 52 with respect to the direction of flow of the air emerging from such open end 51b or 52b, a negative pressure is developed in the annular groove 51e or 52e by the entrainment of air incident to the flow of the air past the constricted area of the supply passage 51d or 52d. Upon development of this negative pressure, air within the diaphragm chamber 48c or 49c is sucked into the associated pneumatic pipe 53 or 54 and, consequently, the diaphragm member 48a or 49a is shifted upwardly.

On the other hand, if there is counter-flow of air at the open end 51*b* or 52*b* of the sensor 51 or 52 with respect to the direction of flow of air from the open end 51*b* or 52*b*, a positive pressure is generated in the annular groove 51*e* or 52*e* by the effect of back pressure. The positive pressure thus developed is then applied to the diaphragm chamber 48*c* or 49*c* and, consequently, the diaphragm member 48*a* or 49*a* is shifted downwardly.

Assuming that the ribbon-shaped stream of cooled air is flowing from the entrance 15 of the assembly 10 and is deflected towards the side wall surface 11*e*, the counter-flow is present at the open end 52*b* of the sensor 52 while no counter-flow is present at the open end 51*b* of the sensor 51. During this condition, starting from the condition as shown in FIG. 14, the diaphragm member 49*a* of the diaphragm unit 49 associated with the sensor 52 is shifted downwardly so as to close the hole 42*b* while the diaphragm member 48*a* of the diaphragm unit 48 associated with the sensor 51 is shifted upwardly so as to open the hole 42*a*. As shown in FIG. 16, upon opening of the hole 42*a* and closing of the hole 42*b* effected in the manner as hereinabove described, the control apertures 13*a* and 13*b* are respectively communicated to the atmosphere and blocked off from the atmosphere and, consequently, the direction of deflection of the ribbon-shaped stream of cooled air is reversed and the stream of air is deflected towards the side wall surface 12*e*.

Upon the change of the direction of the flow of the cooled air flowing from the entrance 15, the counter-flow becomes present at the open end 51*b* of the sensor 51 while no counter-flow is present at the open end 52*b* of the sensor 52. During this condition, as shown in FIG. 14, the diaphragm member 48*a* is shifted downwardly so as to close the hole 42*a* while the diaphragm member 49*a* is shifted upwardly so as to open the hole 42*b*, as shown in FIG. 16, thereby allowing the control apertures 13*a* and 13*b* to be blocked off from and communicated to the atmosphere, respectively. The consequence is that the direction of deflection of the ribbon-shaped stream of cooled air is again changed so that it is deflected towards the side wall surface 11*e*.

From the foregoing, it is clear that lateral swinging of the ribbon-shaped stream of the cooled air emerging from the exit grill Hc (FIG. 6) takes place.

Figure 17:
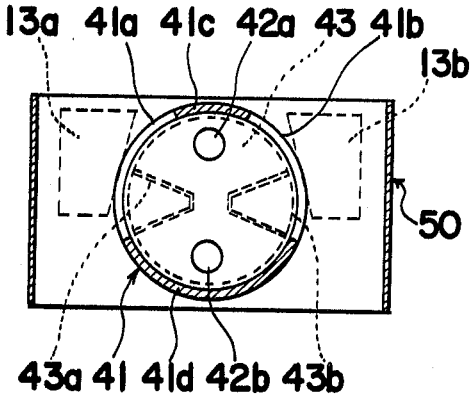

Referring now to FIG. 17, the rotary shutter 40 is rotated clockwise through 90° about the axis of rotation of said shutter 40, that is, the longitudinal axis of the boss 43, to the position shown from the position shown in FIG. 16. When the position shown in FIG. 17 is established, the control aperture 13*a* is communicated to the atmosphere through the window 41*a* via the passage 43*a* while the control aperture 13*b* is communicated to the atmosphere through the window 41*b* via the passage 43*b*. Accordingly, the ribbon-shaped stream of cooled air flowing from the entrance 15 of the assembly 10 flows straight without flowing along either of the side wall surfaces 11*e* and 12*e*, i.e., in the direction as indicated by F in FIG. 3.

Figure 18:
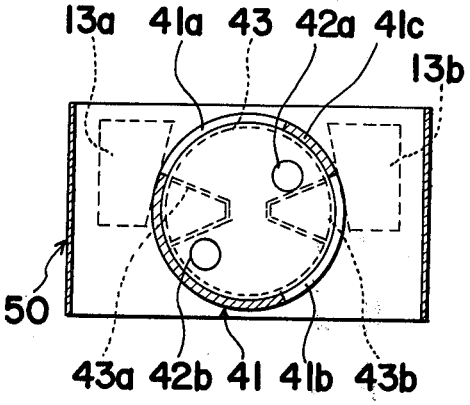

However, when the rotary shutter 40 is further rotated 45° clockwise from the position shown in FIG. 17, the control aperture 13*a* is blocked off from the atmosphere with the interceptor wall portion 41*d* of the cylindrical wall 41 closing the passage 43*a* while the control aperture 13*b* is still in communication with the atmosphere through the window 41*b* via the passage 43*b*, as shown in FIG. 18. During the time when the shutter 40 is in the position of FIG. 18, therefore, the ribbon-shaped stream of cooled air is deflected towards the side wall surface 11*e* flowing in the direction as indicated by $F_2$ in FIG. 3.

It is to be noted that, during the rotation of the rotary shutter 40 from the position shown in FIG. 17 towards the position shown in FIG. 18, the size of the opening of the passage 43*a* through the window 41*a* is gradually reduced with the interceptor wall portion 41*d* correspondingly gradually overlapping the passage 43*a*, while the passage 43*b* is still in communication with the atmosphere through the window 41*b*. During this time, therefore, the ribbon-shaped stream of cooled air gradually deflects from the center plane of the assembly 10 towards the side wall surface 11*e*.

Starting from the position shown in FIG. 17, if the rotary shutter 40 is rotated 45° counterclockwise about the axis of rotation, the opening of the passage 43*b* through the window 41*a* is gradually reduced with the interceptor wall portion 41*d* correspondingly gradually overlapping the passage 43*b*, while the passage 43*a* is still in communication with the atmosphere through the window 41*a*. In response to the reduction in the size of the opening of the passage 43*b* through the window 41*a* effected in the manner as hereinbefore described, the pressure within the control chamber 12*d* gradually decreases so that the ribbon-shaped stream of cooled air, which has been flowing in the direction indicated by F in FIG. 3, correspondingly deflects towards the side wall surface 12*e*.

In summary, by the rotation of the rotary shutter 40 to any desired position, the direction of deflection of the stream of cooled air can be selected as desired and, in addition, the swinging motion of the stream can be interrupted.

The arrangement shown in FIGS. 10 to 18 functions in a substantially reliable manner because no mechanical movable parts are employed.

The fluid diverting assembly 10 having the construction shown in FIGS. 1 to 3 may also be employed in an air conditioner of the type generally referred to as "a separate type". The separate model is known as comprising an indoor unit and an outdoor unit which are respectively positioned within a house room and outside the house room and which are connected by a piping through which fluid medium, such as a coolant, flows between a heat exchanger in the indoor unit and a heat exchanger in the outdoor unit. A compressor necessary to effect recirculation of the coolant between these heat exchangers through the piping is usually installed in the outdoor unit.

An example of application of the fluid diverting assembly 10 to the separate type will now be described with particular reference to FIGS. 19 to 23. However, it is to be noted that, since the separate type is well known to those skilled in the art, only the outdoor unit is shown in FIGS. 19 and 20 and will be described in terms of its operation.

Figure 19:
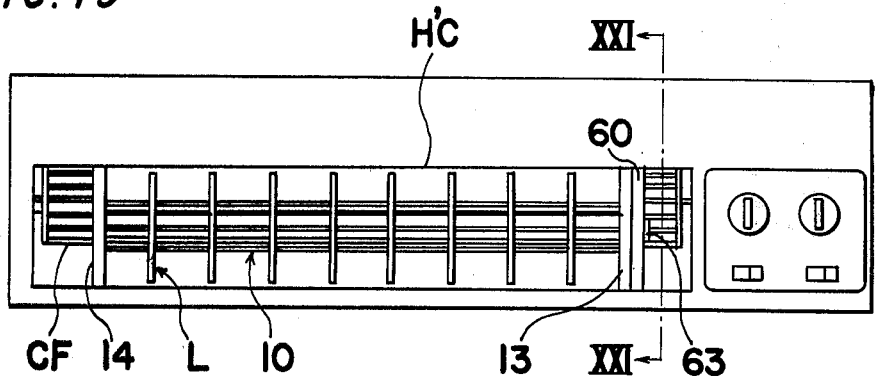
FIG. 19 is a front elevational view of a portion of a front panel of an indoor unit of an air conditioner known as a separate type.
Figure 20:
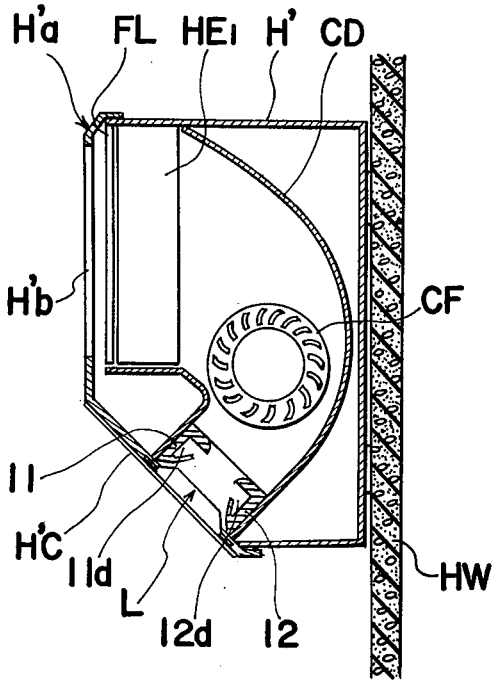
FIG. 20 is a side sectional view of the air-conditioner partially shown in FIG. 19.

Referring to FIGS. 19 and 20, the indoor unit is shown as being secured to a partition wall of a house in any known manner, which partition wall HW separates a house room from the outside. The indoor unit of the air conditioner is usually positioned adjacent the ceiling (not shown) of the house room. The air conditioner, of which the indoor unit is shown, is to be understood as being a heat-pump type capable of selectively heating and cooling the house room through the indoor unit, the heat pump type being well known to those skilled in the art.

The purpose for which the assembly 10 is employed in the illustrated indoor unit of the air conditioner of the heat-pump type is to direct the ribbon-shaped stream of air emerging from the indoor unit so as to flow along and below the ceiling within the house room when such air is cooled and therefore is used to cool the house room and to direct the same stream of air so as to flow downwards and along the partition wall when such air is heated and therefore is used to heat the house room. The reason for the necessity to change the direction of flow of the air emerging from the indoor unit depending upon the mode of operation of the air conditioner, that is, cooling and heating, is also well known to those skilled in the art.

Referring still to FIGS. 19 and 20, the indoor unit comprises a housing H' of substantially rectangular box-like configuration having an opening at one side, which opening is closed by a front panel H'*a* composed of an intake grill portion H'*b*, shown to extend in parallel relation to the partition wall HW, and an exit grill portion H'*c* shown to extend at about 45° relative to the plane of the intake grill portion H'*b* in a direction rearwardly and towards the wall HW. Within the housing H', there is provided a cross flow fan CF extending widthwise of the housing H'. This fan CF, during its rotation in one direction, draws air within the house room into the closed duct CD through the intake grill portion H'*b*, then the dust removing filter FL and finally through the heat exchanger $HE_1$. The air within the closed duct CD, which has already been either cooled or heated during its passage through the heat exchanger $HE_1$ as is well known to those skilled in the art, is further driven, during the continued rotation of the fan CF, towards the exit grill portion H'*c*.

The exit grill portion H'*c* of the front panel H'*a* is provided with the louver assembly L which, in the embodiment shown in FIGS. 19 to 23, serves to select the direction of flow of the air emerging from the exit grill portion H'*c* so that it is in any desired horizontal position.

The assembly 10 is installed within the closed duct CD in a manner similar to that shown in FIG. 5 and positioned upstream of the exit grill portion and downstream of the closed duct CD with respect to the direction of flow of air caused by the rotation of the cross flow fan CF. Preferably, the assembly 10 is positioned with the center plane thereof extending at about 45° relative to the horizontal datum or the plane of the partition wall HW.

For directing the ribbon-shaped stream of air, as it passes the entrance 15 of the assembly 10 and subsequently emerges from the exit grill portion H'*c*, in any desired direction on both sides of the center plane of the assembly 10, there is utilized the interceptor mechanism having a construction particularly shown in FIGS. 21 to 23.

Before describing the construction of the interceptor mechanism, it is to be noted that the length of the assembly 10 as measured widthwise of the housing H' should be smaller than the axial length of the cross flow fan CF and be positioned below and substantially intermediate the length of said fan CF due to the fact that flow distribution at each end portion of the fan CF tends to be uneven. This need not be done if a rectifier similar in function to the rectifier R described in connection with the embodiment of FIGS. 5 to 9, is employed upstream of the assembly 10.

Figure 21:
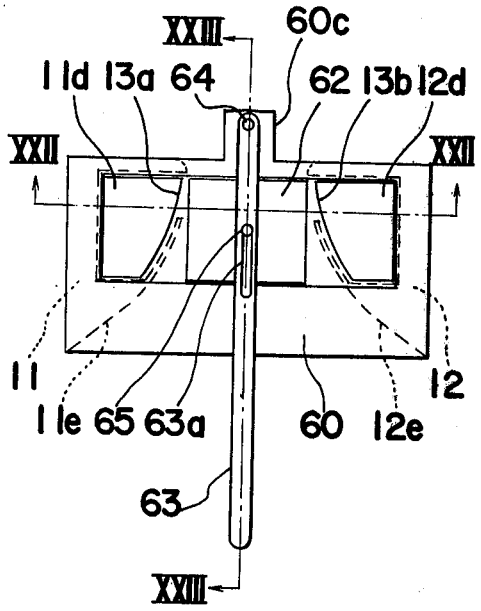
FIG. 21 is a cross sectional view taken along the line XXI—XXI in FIG. 19.
Figure 22:
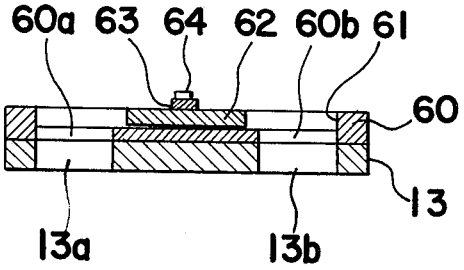
FIG. 22 is a cross sectional view taken along the line XXII—XXII in FIG. 21.
Figure 23:
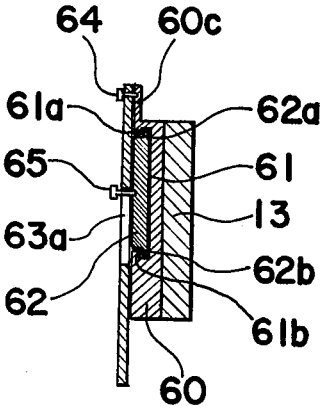
FIG. 23 is a cross sectional view taken along the line XXIII—XXIII in FIG. 21.

Referring now to FIGS. 21 to 23, the interceptor mechanism comprises a support plate 60 having a shape similar to the shape of the end plate 13 and secured externally to said end plate 13. This support plate 60 has a pair of spaced openings 60*a* and 60*b* respectively aligned with the control apertures 13*a* and 13*b* in the end plate 13. As best shown in FIG. 22, the support plate 60 has a rectangular recess 61 extending substantially halfway through the thickness of said support plate 60, the opposed end portions in the recess 61 being occupied by the spaced openings 60*a* and 60*b*. As best shown in FIG. 23, the opposed side walls, which define the recess 61 in cooperation with the opposed side walls, have guide grooves 61*a* and 61*b*.

The interceptor mechanism further comprises a closure plate 62 having lateral projections 62*a* and 62*b* integral therewith. This closure plate 62 is accommodated within the recess 61 and supported by said plate 60 with its lateral projections 62*a* and 62*b* slidingly engaged in the associated guide grooves 61*a* and 61*b* for adjustable movement between left and right positions as viewed in FIG. 21. The closure plate 62 has a size such that, when the closure plate 62 is positioned between the left and right positions as shown in FIG. 21, it will not overlap any portion of the openings 60*a* and 60*b* and, therefore, the control apertures 13*a* and 13*b* as shown in FIG. 22.

For adjusting movement of the closure plate 62, a control handle 63 is utilized. This control handle 63 has one end pivotally connected to a lug 60*c*, integral with the support plate 60, by means of a pin member 64, and the other end extends through the exit grill portion H'*c* and, therefore, is accessible to the hand of a user of the air conditioner. The control handle 63 is operatively coupled to the closure plate 62 by means of a headed set pin 65 loosely extending through a slot 63*a* in the control handle and tapped into the plate 62. The length of the slot 63*a* is selected so that, when the handle 63 is manually pivoted clockwise about the pin member 64 as viewed in FIG. 21, the closure plate 62 is brought to the left position to close the opening 60*a* and, therefore, the control aperture 13*a*, and when the control handle 63 is pivoted counterclockwise about the pin member 64, the closure plate 62 is brought to the right position to close the opening 60*b* and, therefore, the control aperture 13*b*.

From the foregoing, it is clear that, when the control handle 63 is pivoted upwards about the pin member 64 as viewed in FIG. 19 to move the closure plate 62 to the left position as viewed in FIG. 21, the control aperture 13*a* is therefore closed and the pressure reduction takes place within the control chamber 11*d*. Thereupon, the ribbon-shaped stream of air issuing from the entrance 15 is deflected, flowing towards the house room along the side wall surface 11*e* and through the exit grill portion and further flowing adjacent and in a direction substantially parallel to the ceiling of the house room. This setting of the control handle 63 is recommended when the air conditioner is set to perform in the cooling mode.

On the other hand, when the control handle 63 is pivoted downwards as viewed in FIG. 19 to move the closure plate 62 towards the right position as viewed in FIG. 21, the control aperture 13*b* is therefore closed and the pressure reduction takes place within the control chamber 12*d*. Thereupon, the ribbon-shaped stream of air issuing from the entrance 15 is deflected, flowing towards the house room along the side wall surface 12*e* and through the exit grill portion and further flowing downwards and in a direction along the substantially parallel to the partition wall HW. This setting of the control handle 63 is recommended when the air conditioner is set to perform in these heating mode.

Although the present invention has fully been described in connection with the preferred embodiments thereof, it is to be noted that various changes and modifications will be apparent to those skilled in the art. Such changes and modifications, unless they depart from the true scope of the present invention, are to be understood as included within the true scope of the present invention.

What is claimed is:

1. A fluid diverting assembly comprising: a plate-like sheet of rigid material having an aperture therein forming a nozzle for issuing a main stream of fluid as the fluid passes therethrough, said sheet of material having a relatively small dimension in the direction of the thickness thereof as compared with the width of the nozzle in the direction at right angles to the direction of flow of the fluid therethrough, the edges of said sheet of material around said aperture forming said nozzle having a shape for causing the fluid from upstream of said nozzle to flow therethrough in a main stream which is substantially unconstricted and having low inertia so that the direction of flow can be diverted easily; control chamber means positioned downstream of said nozzle and in spaced relation to said nozzle for developing a pressure differential in the main stream of fluid flowing from said nozzle; a pair of spaced opposed walls at a position downstream of said control chamber means and having a shape diverging away from each other in a direction downstream with respect to the direction of flow of the main stream of fluid and opening outwardly in a direction away from said nozzle, said walls being spaced from each other at the upstream side a distance slightly greater than the width of the nozzle for providing space for the main stream of fluid passing through the nozzle to be deflected; and said control chamber means having respective openings opening into the path of the main stream of fluid between said nozzle and said wall and having respective control openings opening into said chamber means having a cross-sectional area of a size sufficient for compensating for the reduction in pressure within the corresponding control chamber means due to the fluid within such control chamber means having been drawn into the main stream of fluid as the main stream of fluid flows past the openings opening into the path of the main stream.

2. The fluid diverting assembly as claimed in claim 1, wherein said nozzle has a curved shape having a cross sectional area gradually decreasing in a direction downstream with respect to the direction of flow of the main stream of fluid.

3. The fluid diverting assembly as claimed in claim 1, wherein said nozzle has a shape having a cross sectional area gradually decreasing and then gradually increasing in a direction downstream with respect to the direction of flow of the main stream of fluid.

4. The fluid diverting assembly as claimed in claim 1, wherein each of said walls is outwardly curved.

5. The fluid diverting assembly as claimed in claim 1, wherein each of said walls is constituted by a curved portion and a straight portion contiguous to said curved portion, but positioned downstream of said curved portion with respect to the direction of flow of the main stream of fluid.

6. A fluid diverting assembly as claimed in claim 1, further comprising interceptor means associated with said control apertures for controlling the amount of the cross-sectional area of each of said control apertures which is open.

7. A fluid diverting assembly as claimed in claim 6, further comprising drive means connected to said interceptor means for continuously operating said interceptor means for adjustably completely or substantially completely closing any said control apertures.

8. The fluid diverting assembly as claimed in claim 7, wherein said drive means comprises an impeller driven in one direction by the flow of a portion of the fluid directed toward the nozzle.

9. The fluid diverting assembly as claimed in claim 8, further comprising a switching means engagable with said impeller for stopping rotation of said wind impeller at any desired position.

10. The fluid diverting assembly as claimed in claim 7, wherein said drive means comprises an electric motor.

11. The fluid diverting assembly as claimed in claim 6, further comprising a flow rectifier positioned upstream of the nozzle.

12. A fluid diverting assembly as claimed in claim 6, wherein said interceptor means is adjustable for adjusting the degree of closure of the control apertures.

13. A fluid diverting assembly as claimed in claim 6, wherein said interceptor means comprises a rotary member having a first aperture alignable with said control aperture by rotation of said rotary member for controlling the opening of the control aperture, said rotary member having a second aperture spaced from said first aperture having a smaller size than said first aperture and alignable with said control aperture by rotation of said rotary member, said second aperture being communicated to said control aperture when communicated between said first aperture and said control aperture is interrupted, and a diaphragm unit positioned adjacent and in spaced relation to said second aperture and movable toward said rotary member for closing said second aperture in response to a fluidic dynamic pressure detected at a position adjacent one of said walls.

* * * * *